US009427751B2

(12) United States Patent
Kim

(10) Patent No.: US 9,427,751 B2
(45) Date of Patent: Aug. 30, 2016

(54) IRRIGATION SPRINKLER NOZZLE HAVING DEFLECTOR WITH MICRO-RAMPS

(75) Inventor: Eugene Ezekiel Kim, Buena Park, CA (US)

(73) Assignee: Rain Bird Corporation, Azusa, CA (US)

( * ) Notice: Subject to any disclaimer, the term of this patent is extended or adjusted under 35 U.S.C. 154(b) by 39 days.

(21) Appl. No.: 12/757,912

(22) Filed: Apr. 9, 2010

(65) Prior Publication Data

US 2011/0248093 A1 Oct. 13, 2011

(51) Int. Cl.
*B05B 1/26* (2006.01)
*B05B 1/30* (2006.01)
*B05B 3/02* (2006.01)

(52) U.S. Cl.
CPC ..... *B05B 1/267* (2013.01); *B05B 1/3073* (2013.01); *B05B 3/021* (2013.01)

(58) Field of Classification Search
CPC ..... B05B 1/26; B05B 1/267; B05B 1/3073; B05B 3/021
USPC ..... 239/11, 457, 460, 498, 513, 539, 239/DIG. 1, 522, 483
See application file for complete search history.

(56) References Cited

U.S. PATENT DOCUMENTS

| | | | | |
|---|---|---|---|---|
| 458,607 | A | 9/1891 | Weiss | |
| 1,523,609 | A | 1/1922 | Roach | |
| 1,432,386 | A | 10/1922 | Curney | |
| 2,125,863 | A | 4/1933 | Munz | |
| 2,075,589 | A * | 3/1937 | Munz | 239/11 |
| 2,125,978 | A | 8/1938 | Arbogast | |
| 2,128,552 | A | 8/1938 | Arbogast | |
| 2,325,280 | A | 8/1938 | Rader | |
| 2,130,810 | A | 9/1938 | Munz | |
| 2,875,783 | A | 4/1941 | Bentley | |
| 2,348,776 | A * | 5/1944 | Bentley | 239/460 |
| 2,634,163 | A | 4/1953 | Double | |
| 2,723,879 | A | 11/1955 | Martin | |
| 2,785,013 | A | 3/1957 | Stearns | |
| 2,935,266 | A | 6/1958 | Coleondro | |
| 3,029,030 | A | 1/1959 | Wiant | |
| 2,914,257 | A * | 11/1959 | Wiant | 239/401 |
| 2,990,123 | A | 6/1961 | Hyde | |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

Advisory Action mailed Jul. 14, 2011 for U.S. Appl. No. 11/947,571 (3 pgs.).

(Continued)

*Primary Examiner* — Arthur O Hall
*Assistant Examiner* — Chee-Chong Lee
(74) *Attorney, Agent, or Firm* — Fitch Even Tabin & Flannery LLP

(57) ABSTRACT

A spray nozzle for an irrigation sprinkler is provided, where the nozzle has a deflector that is configured with depending ribs. Each of the ribs has micro-structures that cooperate with other geometry of the rib and deflector to define a plurality of different micro-ramps for dividing the discharged water into different sprays having different characteristics that can be combined to achieve a spray pattern.

25 Claims, 14 Drawing Sheets

(56) References Cited

U.S. PATENT DOCUMENTS 2,990,128 A 6/1961 Hyde
3,239,149 A 6/1962 Moen
3,109,591 A * 11/1963 Moen ..... 239/107
3,380,659 A 3/1966 Lindberg
3,752,403 A 8/1973 Diest
3,940,066 A 2/1976 Hunter
3,948,285 A 4/1976 Flynn
3,955,764 A 5/1976 Phaup
4,026,471 A 5/1977 Hunter
4,119,275 A 10/1978 Hunter
4,131,234 A 12/1978 Pescetto
4,189,099 A 2/1980 Bruninga
4,253,608 A 3/1981 Hunter
4,272,024 A 6/1981 Kah, Jr.
4,316,579 A 2/1982 Ray
4,353,506 A 10/1982 Hayes
4,353,507 A 10/1982 Kah
4,398,666 A 8/1983 Hunter
4,417,691 A 11/1983 Lockwood
4,456,181 A 6/1984 Burnham
4,471,908 A 9/1984 Hunter
4,479,611 A 10/1984 Galvis
4,501,391 A 2/1985 Hunter
4,566,632 A 1/1986 Sesser
4,568,024 A 2/1986 Hunter
4,579,284 A 4/1986 Arnold
4,579,285 A 4/1986 Hunter
4,609,146 A 9/1986 Walto
4,618,100 A 10/1986 White et al.
4,624,412 A 11/1986 Hunter
4,625,917 A 12/1986 Torney
RE32,386 E 3/1987 Hunter
4,660,766 A 4/1987 Nelson
4,669,663 A 6/1987 Meyer
4,676,438 A 6/1987 Sesser
4,681,260 A 7/1987 Cochran
4,681,263 A 7/1987 Cockman
4,682,732 A 7/1987 Walto
4,699,321 A 10/1987 Bivens
4,708,291 A 11/1987 Grundy
4,718,605 A 1/1988 Hunter
4,720,045 A 1/1988 Meyer
4,739,934 A 4/1988 Gewelber
D296,464 S 6/1988 Marmol
4,752,031 A 6/1988 Merrick
4,763,838 A 8/1988 Holcomb
4,784,325 A 11/1988 Walker et al.
4,796,809 A 1/1989 Hunter
4,796,811 A 1/1989 Davisson
4,815,662 A 3/1989 Hunter
4,834,289 A 5/1989 Hunter
4,836,449 A 6/1989 Hunter
4,836,450 A 6/1989 Hunter
4,840,312 A 6/1989 Tyler
4,842,201 A 6/1989 Hunter
4,898,332 A 2/1990 Hunter
4,901,924 A 2/1990 Kah, Jr.
4,932,590 A 6/1990 Hunter
4,944,456 A 7/1990 Zakai
4,948,052 A 8/1990 Hunter
4,955,542 A 9/1990 Kah, Jr.
4,961,534 A 10/1990 Tyler
4,967,961 A 11/1990 Hunter
4,971,250 A 11/1990 Hunter
D312,865 S 12/1990 Davisson
4,986,474 A 1/1991 Schisler
5,031,840 A 7/1991 Grundy
5,050,800 A 9/1991 Lamar
5,052,621 A 10/1991 Katzer
5,058,806 A 10/1991 Rupar
5,078,321 A 1/1992 Davis
5,083,709 A 1/1992 Iwanowski
RE33,823 E 2/1992 Nelson
5,086,977 A 2/1992 Kah, Jr.
5,090,619 A 2/1992 Barthold et al.
5,104,045 A 4/1992 Kah, Jr.
5,123,597 A 6/1992 Bendall
5,141,024 A 8/1992 Hicks
5,148,990 A 9/1992 Kah, Jr.
5,148,991 A 9/1992 Kah
5,152,458 A 10/1992 Curtis
5,158,232 A 10/1992 Tyler
5,174,501 A 12/1992 Hadar
5,199,646 A 4/1993 Kah, Jr.
5,205,491 A 4/1993 Hadar
5,224,653 A 7/1993 Nelson
5,226,599 A 7/1993 Lindermeir
5,226,602 A 7/1993 Cochran
5,234,169 A 8/1993 McKenzie
5,240,182 A 8/1993 Lemme
5,240,184 A 8/1993 Lawson
5,267,689 A 12/1993 Forer
5,288,022 A 2/1994 Sesser
5,299,742 A 4/1994 Han
5,322,223 A 6/1994 Hadar
5,335,857 A 8/1994 Hagon
5,360,167 A 11/1994 Grundy
5,370,311 A 12/1994 Chen
5,372,307 A 12/1994 Sesser
5,375,768 A 12/1994 Clark
5,398,872 A 3/1995 Joubran
5,417,370 A 5/1995 Kah
5,423,486 A 6/1995 Hunter
5,435,490 A 7/1995 Machut
5,439,174 A 8/1995 Sweet
RE35,037 E 9/1995 Kah
5,456,411 A 10/1995 Scott
5,503,139 A 4/1996 McMahon
5,526,982 A 6/1996 McKenzie
5,544,814 A 8/1996 Spenser
5,556,036 A * 9/1996 Chase ..... 239/457
5,588,594 A 12/1996 Kah, Jr.
5,588,595 A 12/1996 Sweet
5,598,977 A 2/1997 Lemme
5,611,488 A 3/1997 Frolich
5,620,141 A 4/1997 Chiang
5,640,983 A 6/1997 Sherman, Jr.
5,642,861 A 7/1997 Ogi
5,653,390 A 8/1997 Kah
5,662,545 A 9/1997 Zimmerman
5,671,885 A 9/1997 Davisson
5,671,886 A 9/1997 Sesser
5,676,315 A 10/1997 Han
D388,502 S 12/1997 Kah
5,695,123 A 12/1997 Le
5,699,962 A 12/1997 Scott
5,711,486 A 1/1998 Clark
5,718,381 A * 2/1998 Katzer et al. ..... 239/222.11
5,720,435 A 2/1998 Hunter
5,722,593 A 3/1998 McKenzie
5,758,827 A 6/1998 Van Le
5,762,270 A 6/1998 Kearby
5,765,757 A 6/1998 Bendall
5,765,760 A 6/1998 Kuo
5,769,322 A 6/1998 Smith
5,785,248 A 7/1998 Staylor
5,820,029 A 10/1998 Marans
5,823,439 A 10/1998 Hunter
5,823,440 A 10/1998 Clark
5,826,797 A 10/1998 Kah, III
5,845,849 A 12/1998 Mitzlaff
5,875,969 A 3/1999 Grundy
5,918,812 A 7/1999 Beutler
5,927,607 A 7/1999 Scott
5,971,297 A 10/1999 Sesser
5,988,523 A 11/1999 Scott
5,992,760 A 11/1999 Kearby
6,007,001 A 12/1999 Hilton
6,019,295 A 2/2000 McKenzie
6,029,907 A 2/2000 McKenzie
6,042,021 A 3/2000 Clark
6,050,502 A 4/2000 Clark
6,076,744 A 6/2000 O'Brien
6,076,747 A 6/2000 Ming-Yuan

(56) References Cited

U.S. PATENT DOCUMENTS 6,085,995 A 7/2000 Kah, Jr. et al.
6,102,308 A 8/2000 Steingrass
6,109,545 A 8/2000 Kah
6,138,924 A 10/2000 Hunter
6,145,758 A 11/2000 Ogi
6,155,493 A 12/2000 Kearby et al.
6,158,675 A 12/2000 Ogi
6,186,413 B1 2/2001 Lawson
6,223,999 B1 5/2001 Lemelshtrich
6,227,455 B1 5/2001 Scott
6,230,988 B1 5/2001 Chao
6,230,989 B1 5/2001 Haverstraw
6,237,862 B1 5/2001 Kah, III et al.
6,241,158 B1 6/2001 Clark
6,244,521 B1 6/2001 Sesser
6,264,117 B1 7/2001 Roman
6,286,767 B1 9/2001 Hui-Chen
6,332,581 B1 12/2001 Chin
6,336,597 B1 1/2002 Kah
6,341,733 B1 1/2002 Sweet
6,345,541 B1 2/2002 Hendey
6,367,708 B1 4/2002 Olson
D458,342 S 6/2002 Johnson
6,443,372 B1 9/2002 Hsu
6,454,186 B2 9/2002 Haverstraw
6,457,656 B1 10/2002 Scott
6,464,151 B1 10/2002 Cordua
6,478,237 B2 11/2002 Kearby et al.
6,488,218 B1 12/2002 Townsend
6,491,235 B1 12/2002 Scott
6,494,384 B1 12/2002 Meyer
6,499,672 B1 12/2002 Sesser
6,530,531 B2 3/2003 Butler
6,601,781 B2 8/2003 Kah
6,607,147 B2 8/2003 Schneider
6,622,940 B2 9/2003 Huang
6,637,672 B2 10/2003 Cordua
6,651,904 B2 11/2003 Roman
6,651,905 B2 11/2003 Sesser
6,688,539 B2 2/2004 Vander Griend
6,695,223 B2 2/2004 Beutler
6,715,699 B1 4/2004 Greenberg
6,719,218 B2 4/2004 Cool et al.
6,732,952 B2 5/2004 Kah
6,736,332 B2 5/2004 Sesser
6,736,336 B2 5/2004 Wong
6,769,633 B1 8/2004 Huang
6,814,304 B2 11/2004 Onofrio
6,814,305 B2 11/2004 Townsend
6,817,543 B2 11/2004 Clark
6,820,825 B1 11/2004 Wang
6,827,291 B2 12/2004 Townsend
6,834,816 B2 12/2004 Kah, Jr.
6,840,460 B2 1/2005 Clark
6,848,632 B2 2/2005 Clark
6,854,664 B2 2/2005 Smith
6,869,026 B2 3/2005 McKenzie
6,871,795 B2 3/2005 Anuskiewicz
6,880,768 B2 4/2005 Lau
6,883,727 B2 4/2005 De Los Santos
6,921,030 B2 7/2005 Renquist
6,942,164 B2 9/2005 Walker
6,945,471 B2 9/2005 McKenzie
6,957,782 B2 10/2005 Clark
6,997,393 B1 2/2006 Angold
7,017,831 B2 3/2006 Santiago
7,017,837 B2 3/2006 Taketomi
7,028,920 B2 4/2006 Hekman
7,028,927 B2 4/2006 Mermet
7,032,836 B2 * 4/2006 Sesser et al. ..... 239/204
7,032,844 B2 4/2006 Cordua
7,040,553 B2 5/2006 Clark
7,044,403 B2 5/2006 Kah, III
7,070,122 B2 7/2006 Burcham
7,090,146 B1 8/2006 Ericksen
7,100,842 B2 9/2006 Meyer
7,104,472 B2 9/2006 Renquist
7,111,795 B2 9/2006 Thong
7,143,957 B2 12/2006 Nelson
7,143,962 B2 12/2006 Kah, Jr.
7,152,814 B1 12/2006 Schapper
7,156,322 B1 1/2007 Heitzman
7,159,795 B2 1/2007 Sesser
7,168,634 B2 1/2007 Onofrio
7,232,081 B2 6/2007 Kah, Jr.
7,234,651 B2 6/2007 Mousavi
7,240,860 B2 7/2007 Griend
7,287,711 B2 10/2007 Crooks
7,293,721 B2 11/2007 Roberts
7,303,147 B1 12/2007 Danner
7,303,153 B2 12/2007 Han
7,322,533 B2 1/2008 Grizzle
7,337,988 B2 3/2008 McCormick et al.
7,389,942 B2 6/2008 Kenyon
RE40,440 E 7/2008 Sesser
7,392,956 B2 7/2008 McKenzie
7,429,005 B2 9/2008 Schapper
7,478,526 B2 1/2009 McAfee et al.
7,533,833 B2 5/2009 Wang
7,581,687 B2 9/2009 Feith
7,584,906 B2 9/2009 Lev
7,597,273 B2 10/2009 McAfee et al.
7,607,588 B2 10/2009 Nobili
7,611,077 B2 11/2009 Sesser
7,621,467 B1 11/2009 Garcia
7,654,474 B2 2/2010 Cordua
7,686,235 B2 3/2010 Roberts
7,686,236 B2 3/2010 Alexander
7,703,706 B2 4/2010 Walker
7,766,259 B2 8/2010 Feith
D628,272 S 11/2010 Kah, Jr. et al.
7,828,229 B2 11/2010 Kah, Jr.
7,850,094 B2 12/2010 Richmond
7,861,948 B1 1/2011 Crooks
D636,459 S 4/2011 Kah, Jr. et al.
7,926,746 B2 4/2011 Melton
7,971,804 B2 7/2011 Roberts
8,006,919 B2 8/2011 Renquist
8,047,456 B2 11/2011 Kah
8,056,829 B2 11/2011 Gregory
8,074,897 B2 12/2011 Hunnicutt
8,205,811 B2 6/2012 Cordua
8,272,583 B2 9/2012 Hunnicutt
8,651,400 B2 2/2014 Walker
8,672,242 B2 3/2014 Hunnicutt
8,695,900 B2 4/2014 Hunnicutt
8,783,582 B2 7/2014 Robertson
8,789,768 B2 7/2014 Hunnicutt
8,925,837 B2 1/2015 Walker
9,079,202 B2 7/2015 Walker
9,174,227 B2 11/2015 Robertson
2001/0023901 A1 9/2001 Haverstraw
2002/0070289 A1 6/2002 Hsu
2002/0130202 A1 9/2002 Kah, Jr.
2002/0153434 A1 10/2002 Cordua
2003/0006304 A1 1/2003 Cool et al.
2003/0015606 A1 1/2003 Cordua
2003/0042327 A1 3/2003 Beutler et al.
2003/0071140 A1 4/2003 Roman
2003/0075620 A1 4/2003 Kah, Jr.
2004/0108391 A1 6/2004 Onofrio
2005/0006501 A1 1/2005 Englefield
2005/0161534 A1 7/2005 Kah
2005/0194464 A1 9/2005 Bruninga
2005/0194479 A1 9/2005 Curtis
2006/0038046 A1 2/2006 Curtis
2006/0086832 A1 4/2006 Roberts
2006/0086833 A1 4/2006 Roberts
2006/0108445 A1 5/2006 Pinch
2006/0144968 A1 7/2006 Lev
2006/0237198 A1 10/2006 Crampton
2006/0273202 A1 12/2006 Su
2006/0281375 A1 12/2006 Jordan
2007/0012800 A1 1/2007 McAfee et al.

(56) References Cited

U.S. PATENT DOCUMENTS

| | | | |
|---|---|---|---|
| 2007/0034711 | A1 | 2/2007 | Kah |
| 2007/0034712 | A1 | 2/2007 | Kah |
| 2007/0181711 | A1 | 8/2007 | Sesser |
| 2007/0235565 | A1 | 10/2007 | Kah |
| 2007/0246567 | A1 | 10/2007 | Roberts |
| 2008/0169363 | A1 | 7/2008 | Walker |
| 2008/0217427 | A1 | 9/2008 | Wang et al. |
| 2008/0257982 | A1 | 10/2008 | Kah |
| 2008/0276391 | A1 | 11/2008 | Jung |
| 2008/0277499 | A1 | 11/2008 | McAfee et al. |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah, Jr. |
| 2009/0173904 | A1 | 7/2009 | Roberts |
| 2009/0188988 | A1 | 7/2009 | Walker |
| 2009/0224070 | A1 | 9/2009 | Clark |
| 2010/0090024 | A1 | 4/2010 | Hunnicutt |
| 2010/0108787 | A1 | 5/2010 | Walker |
| 2010/0176217 | A1 | 7/2010 | Richmond |
| 2010/0257670 | A1 | 10/2010 | Hodel |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2011/0024522 | A1 | 2/2011 | Anuskiewicz |
| 2011/0024526 | A1 | 2/2011 | Feith et al. |
| 2011/0089250 | A1 | 4/2011 | Zhao |
| 2011/0147484 | A1 | 6/2011 | Walker |
| 2011/0248093 | A1 | 10/2011 | Kim |
| 2011/0248094 | A1 | 10/2011 | Robertston et al. |
| 2011/0248097 | A1 | 10/2011 | Kim |
| 2011/0309161 | A1 | 12/2011 | Renquist |
| 2012/0012670 | A1 | 1/2012 | Kah |
| 2012/0061489 | A1 | 3/2012 | Hunnicutt |
| 2012/0153051 | A1 | 6/2012 | Kah |
| 2012/0292403 | A1 | 11/2012 | Hunnicutt |
| 2013/0334340 | A1 | 12/2013 | Walker et al. |
| 2014/0027526 | A1 | 1/2014 | Shadbolt |
| 2014/0027527 | A1 | 1/2014 | Walker |

FOREIGN PATENT DOCUMENTS

| | | |
|---|---|---|
| CN | 2794646 | 7/2006 |
| CN | 2805823 | 8/2006 |
| DE | 1283591 B | 11/1968 |
| DE | 3335805 A1 | 2/1985 |
| EP | 463742 | 1/1992 |
| EP | 489679 | 6/1992 |
| EP | 518579 | 12/1992 |
| EP | 572747 | 12/1993 |
| EP | 646417 | 4/1995 |
| EP | 724913 | 8/1996 |
| EP | 0761312 A1 | 12/1997 |
| EP | 1016463 | 7/2000 |
| EP | 1043075 | 10/2000 |
| EP | 1043077 | 10/2000 |
| EP | 1173286 | 1/2002 |
| EP | 1250958 | 10/2002 |
| EP | 1270082 | 1/2003 |
| EP | 1289673 | 3/2003 |
| EP | 1426112 | 6/2004 |
| EP | 1440735 | 7/2004 |
| EP | 1452234 | 9/2004 |
| EP | 1502660 | 2/2005 |
| EP | 1508378 | 2/2005 |
| EP | 1818104 | 8/2007 |
| EP | 1944090 | 7/2008 |
| EP | 2255884 A1 | 1/2010 |
| EP | 2251090 A2 | 11/2010 |
| GB | 1234723 | 6/1971 |
| GB | 2330783 | 5/1999 |
| WO | WO 9520988 | 8/1995 |
| WO | WO 9727951 | 8/1997 |
| WO | 9735668 | 10/1997 |
| WO | WO 0007428 | 12/2000 |
| WO | 0131996 | 5/2001 |
| WO | WO 0131996 | 5/2001 |
| WO | 0162395 | 8/2001 |
| WO | WO 0162395 | 8/2001 |
| WO | WO 02078857 | 10/2002 |
| WO | WO 02098570 | 12/2002 |
| WO | WO 03086643 | 10/2003 |
| WO | WO 2004052721 | 6/2004 |
| WO | 2005099905 | 10/2005 |
| WO | 2005115554 | 12/2005 |
| WO | 2005123263 | 12/2005 |
| WO | WO 2006108298 | 10/2006 |
| WO | WO 2007131270 | 11/2007 |
| WO | 2008/130393 | 10/2008 |
| WO | 2009/036382 | 3/2009 |
| WO | 2010036241 | 4/2010 |
| WO | 2010126769 | 11/2010 |
| WO | 2011075690 | 6/2011 |

OTHER PUBLICATIONS

Applicant-Initiated Interview Summary and Final Office Action mailed Mar. 5, 2014 for U.S. Appl. No. 12/972,271 (12 pgs.).

Applicant-Initiated Interview Summary mailed Mar. 5, 2014 for U.S. Appl. No. 12/859,159 (3 pgs.).

European Patent Office Search Report and Opinion dated Aug. 5, 2010 for Application No. 10164085.2 (5 pgs.).

Final Office Action mailed Apr. 5, 2011 for U.S. Appl. No. 11/947,571 (11 pgs.).

Final Office Action mailed Dec. 4, 2013 for U.S. Appl. No. 12/859,159 (12 pgs.).

Final Office Action mailed Dec. 5, 2013 for U.S. Appl. No. 12/972,271 (9 pgs.).

Interview Summary mailed Sep. 26, 2011 for U.S. Appl. No. 12/475,242 (3 pgs.).

Issue Notification mailed Jul. 2, 2014 for U.S. Appl. No. 12/859,159 (1 pg.).

Non-Final Office Action dated Jan. 10, 2014 for U.S. Appl. No. 13/069,334 (6 pgs.).

Non-Final Office Action mailed Apr. 10, 2013 for U.S. Appl. No. 13/562,825 (22 pgs.).

Non-Final Office Action mailed Aug. 24, 2010 for U.S. Appl. No. 11/947,571 (11 pgs.).

Non-Final Office Action mailed Dec. 4, 2012 for U.S. Appl. No. 12/686,895 (29 pgs.).

Non-Final Office Action mailed Jan. 5, 2011 for U.S. Appl. No. 12/248,644 (20 pgs.).

Non-Final Office Action mailed Jul. 20, 2011 for U.S. Appl. No. 12/475,242 (17 pgs.).

Non-Final Office Action mailed Jun. 5, 2013 for U.S. Appl. No. 12/972,271 (25 pgs.).

Non-Final Office Action mailed Jun. 7, 2012 for U.S. Appl. No. 13/300,946 (9 pgs.).

Non-Final Office Action mailed Mar. 29, 2011 for U.S. Appl. No. 12/475,242 (7 pgs.).

Non-Final Office Action mailed May 24, 2013 U.S. Appl. No. 12/720,261 (67 pgs.).

Non-Final Office Action mailed May 29, 2013 for U.S. Appl. No. 12/859,159 (19 pgs.).

Non-Final Office Action mailed Oct. 12, 2012 for U.S. Appl. No. 13/300,946 (7 pgs.).

Non-Final Office Action mailed Oct. 15, 2012 for U.S. Appl. No. 13/562,825 (10 pgs.).

Non-Final Office Action mailed Sep. 3, 2013 for U.S. Appl. No. 13/300,946. (5 pgs.).

Non-Final Office Action mailed Sep. 30, 2010 for U.S. Appl. No. 12/248,644 (7 pgs.).

Notice of Allowability mailed Jun. 23, 2014 for U.S. Appl. No. 12/859,159 (6 pgs.).

Notice of Allowance and Fees Due mailed Mar. 14, 2014 for U.S. Appl. No. 12/859,159 (12 pgs.).

(56) References Cited

OTHER PUBLICATIONS

Response dated Apr. 29, 2011 to Office Action mailed Mar. 29, 2011 for U.S. Appl. No. 12/475,242 (13 pgs.).
Response dated Feb. 10, 2014 to Office Action mailed Jan. 10, 2014 for U.S. Appl. No. 13/069,334 (3 pgs.).
Response dated Jun. 25, 2012 to Office Action mailed Jun. 7, 2012 for U.S. Appl. No. 13/300,946 (12 pgs.).
Response dated Mar. 4, 2014 to Final Office Action mailed Dec. 4, 2013 for U.S. Appl. No. 12/859,159 (19 pgs.).
Response dated Nov. 24, 2010 to Office Action mailed Aug. 24, 2010 for U.S. Appl. No. 11/947,571 (19 pgs.).
Response dated Oct. 18, 2011 to Office Action mailed Jul. 20, 2011 for U.S. Appl. No. 12/475,242 (17 pgs.).
Response dated Oct. 29, 2013 to Non-Final Office Action mailed May 29, 2013 for U.S. Appl. No. 12/859,159 (13 pgs.).
Response dated Sep. 16, 2013 to Office Action mailed Jun. 5, 2013 for U.S. Appl. No. 12/972,271 (15 pgs.).
U.S. Appl. No. 61/681,798, filed Aug. 10, 2012. (27 pgs.).
U.S. Appl. No. 61/681,802, filed Aug. 10, 2012. (23 pgs.).
Written Opinion of the International Searching Authority and International Search Report date of mailing Apr. 19, 2011 for Application No. PCT/US10/61132 (12 pgs.).
Office Action dated Apr. 1, 2014 for U.S. Appl. No. 13/069,334 (9 pgs.).
Office Action dated Oct. 7, 2014 for U.S. Appl. No. 13/523,846 (5 pgs.).
Office Action mailed Oct. 30, 2014 for U.S. Appl. No. 13/069,334 (15 pgs.).
Office Action mailed Apr. 27, 2015 for U.S. Appl. No. 13/069,334 (16 pgs.).
Notice of Allowance mailed Feb. 23, 2015 for U.S. Appl. No. 13/523,846 (5 pgs.).
Amendment dated Aug. 27, 2015 for U.S. Appl. No. 13/069,334 (9 pgs.).
Office Action mailed Sep. 3, 2015 for U.S. Appl. No. 13/069,334 (16 pgs.).
Amendment dated Jan. 4, 2016 for U.S. Appl. No. 13/069,334 (13 pgs.).
Notice of Allowance mailed Jun. 19, 2015 for U.S. Appl. No. 13/523,846 (25 pgs.).
Amendment dated Feb. 9, 2015 for U.S. Appl. No. 13/523,846 (12 pgs.).
Office Action mailed Oct. 7, 2014 for U.S. Appl. No. 13/523,846 (5 pgs.).
USPTO; U.S. Appl. No. 13/069,334; Office Action mailed May 26, 2016.

* cited by examiner

IRRIGATION SPRINKLER NOZZLE HAVING DEFLECTOR WITH MICRO-RAMPS

FIELD

This disclosure relates generally to an irrigation sprinkler nozzle and, in particular, to an irrigation sprinkler nozzle having a deflector.

BACKGROUND

Efficient irrigation is a design objective of many different types of irrigation devices, such as gear-drive rotors, rotary spray nozzles, and fixed spray nozzles. That objective has been heightening due to concerns at the federal, state and local levels of government regarding the efficient usage of water. Over time, irrigation devices have become more efficient at using water in response to these concerns. However, those concerns are ongoing as demand for water increases.

As typical irrigation sprinkler devices project streams or sprays of water from a central location, there is inherently a variance in the amount of water that is projected to areas around the location of the device. For example, there may be a greater amount of water deposited further from the device than closer to the device. This can be disadvantageous because it means that some of the area to be watered will be over watered and some of the area to be watered will receive the desired about of water or, conversely, some of the area to be watered will receive the desired amount of water and some will receive less than the desired about of water. In other words, the distribution of water from a single device is often not uniform.

One measure of how uniformly water is applied to an area being watered is called Distribution Uniformity "DU", which is expressed as a percentage. One common measure of Distribution Uniformity is the Lower Quarter Distribution Uniformity ("$DU_{lq}$"), which is a measure of the average of the lowest quarter of samples, divided by the average of all samples:

$$DU_{lq} = \frac{\text{Average Catch of Lower Quarter} \times 100}{\text{Average Catch Overall}}$$

For example, if all samples are equal, the DU is 100%. If a proportion of the area greater than 25% receives zero application the DU will be 0%. DU can be used to determine the total watering requirement during irrigation scheduling. For example, one may want to apply not less than one inch of water to the area being watered. If the DU were 75%, then the total amount to be applied would be the desired about of water (one inch) divided by the DU (75%), or 1.33 inches of water would be required so that only a very small area receives less than one inch of water. The lower the DU, the less efficient the distribution and the more water that must be applied to meet the minimum desired. This can result in undesirable over watering in one area in order to ensure that another area receives the minimum water desired.

Another measurement is called the Scheduling Coefficient ("SC"). Unlike the DU, the scheduling coefficient does not measure average uniformity. Instead, it is a direct indication of the dryness of the driest turf areas (critical areas). The measurement is called the Scheduling Coefficient because it can play a role in establishing irrigation times. It is based on the critical area to be watered. To calculate the SC, one first identifies the critical area in the water application pattern which is receiving the least amount of water. The amount of water applied to this critical area is divided into the average amount of water applied throughout the irrigated area to obtain the Schedule Coefficient. The scheduling coefficient indicates the amount of extra watering needed to adequately irrigate the critical area. If perfect uniformity were obtained, the scheduling coefficient would be 1.0 (no extra watering needed to adequately irrigate the critical area). By way of example, assume that an irrigation pattern has a scheduling coefficient of 1.8. After 15 minutes of irrigation, a critical area would still be under-watered due to non-uniformity. It will take an additional 12 minutes (15 minutes×0.8) to apply an adequate amount of water to the critical area (or 27 minutes total). While that is the amount of time needed to water the critical area, the result is that other areas will be over-watered.

There are many applications where conventional spray nozzle irrigation devices are desirable for use. Unfortunately, conventional spray nozzle irrigation devices can undesirably have lower $DU_{lq}$ values. For example, some conventional fixed spray devices can have $DU_{lq}$ values of about 65% and be considered to have a very good rating, $DU_{lq}$ values of about 70% for rotors are considered to have a very good rating.

SUMMARY

Spray nozzles having either an arcuately fixed or adjustable spray patterns are described herein, wherein the nozzles have deflectors that are configured with depending ribs having micro-structures that cooperate with other geometry of the rib and deflector to define a plurality of different micro-ramps for dividing the discharged water into different sprays having different characteristics. The different sprays with the different characteristics combine to provide for an improved spray pattern. The result is that advantageously higher $DU_{lq}$ and lower SC values can be achieved, including in a variable arc nozzle.

Water is discharged through one or more flow openings upstream of the deflector in a direction that is generally parallel a central axis of the nozzle (or at an angle from perpendicular thereto). When the discharged water hits an inclined portion of the deflector, the deflector redirects the water outwardly, with the ribs generally confining the water to being radially outwardly. However, the momentum of the water reacts to the impact with the deflector by wanting to move outwardly against the bottom of channels formed between adjacent pairs of the ribs as well against the sidewalls of the ribs. Essentially, the behavior of the water upon impact with the deflector is such that a significant fraction wants to remain close to the structure as opposed to completely filling the channels. In other words, a large fraction of the water tends to "ride along" the sides of the ribs and the bottom of the channels. In order to take advantage of this behavior of the discharged water, very minute structural variances in the portions of the deflector that the water comes into contact with can have a significant impact on the water passing thereagainst. That is, making non-uniform ribs, such as with steps or other protuberances or variations, can provide micro-ramps for altering the flow pattern of the water thereagainst as compared to adjacent water flows. In this manner, the discharging flow of water can be segregated by the deflector into different sprays having different characteristics which can be tailored to achieve certain objectives, such as sprays that are intended to irrigate different areas which, when combined, can result in a more efficient irrigation spray pattern.

In one aspect, a spray nozzle is provided having a deflector body downstream of a flow opening to deflect water discharge from the flow opening. The deflector body has a plurality of depending ribs forming channels for water flow therebetween, and a plurality of the ribs each have an outwardly-extending step at least partially along the length of the ribs such that a micro-ramp extends into the channels for directing a portion of the water flow.

In another aspect, a spray nozzle is provided having a base having a longitudinal axis and at least one water passage extending through base. A deflector body has an upper deflector portion and a lower neck and is fixed relative to the base. The deflector body has a plurality of radially-outward extending, depending ribs forming channels for water flow therebetween, where the ribs each having a pair of sidewalls and a bottom wall with the sidewalls each having a primary micro-ramp projecting laterally a first distance from the sidewall and spaced from a bottom of the channel to define a primary path for water flow outwardly from the nozzle.

In either of the foregoing aspects, the spray nozzle may be of a fixed-arc type or a variable arc-type. In the case of a variable arc-type spray nozzle, a first nozzle body may be provided having a first helical surface. A second nozzle body can be rotatably associated with the first nozzle body and can include a second helical surface. The first and second helical surfaces are configured to cooperate to define an arcuate flow opening adjustable in size to determine an arc of water distribution upon rotation of the first nozzle body relative to the second nozzle body. In one example, the second nozzle body can be in the form of a collar and the first nozzle body can include a deflector that are mounted for relative rotation. The collar has a collar helical surface configured to cooperate with a deflector helical surface of the deflector to define an arcuate flow opening, upstream of an upper deflector portion, that is adjustable in size to determine an arc of water distribution upon rotation of the collar relative to the deflector.

A method is also provided for distributing water from the spray nozzle which includes the step of deflecting at least some of the water radially outward along a plurality of flow paths disposed between adjacent pairs of the ribs and the bottom of the channels, a first of the flow paths on a side of the steps closer to the bottom wall having a first fraction of the total discharged water volume and a second of the flow paths on a side of the step opposite the bottom wall having a second fraction of the total discharged water volume, the second fraction being different than the first fraction.

In any of the foregoing aspects, the deflector body may optionally have an upper portion with an underside with the depending ribs thereon and a lower portion with a neck depending from the underside with a plurality of flow notches disposed about its outer periphery. The flow notches may be aligned with channels formed between the ribs such that a water flow path extends through the flow notches into the channels.

DETAILED DESCRIPTION

As shown in the exemplary drawings, a new and improved sprinkler spray nozzle for use in irrigation is provided. The spray nozzle has a deflector that provides for the separation of discharging water into different sprays in order to improve the overall spray pattern and, in particular, the $DU_{lq}$ and SC values associated with the spray nozzle. Unlike conventional spray nozzles, which often have deflectors with simple, radially-extending vanes, the deflector of the exemplary embodiment has a deflector with depending ribs, where the ribs in turn each have one or more micro-ramps or other structures protruding into the flow paths of the water which guide the deflected water flow in different sprays which can have different characteristics. The different sprays with the different characteristics combine to provide for an improved spray pattern. Moreover, the spray pattern can be tailored by adjusting the geometries of the micro-ramps and the ribs depending upon the desired application or irrigation spray pattern. In one aspect, the deflector can receive discharging water from an arcuately-adjustable opening such that the arc of the spray pattern can be adjusted. However, the deflector described herein and, in particular, the division of the deflected fluid, can also be incorporated into a fixed spray-type sprinkler nozzle or a rotary-type sprinkler nozzle.

Figure 1:
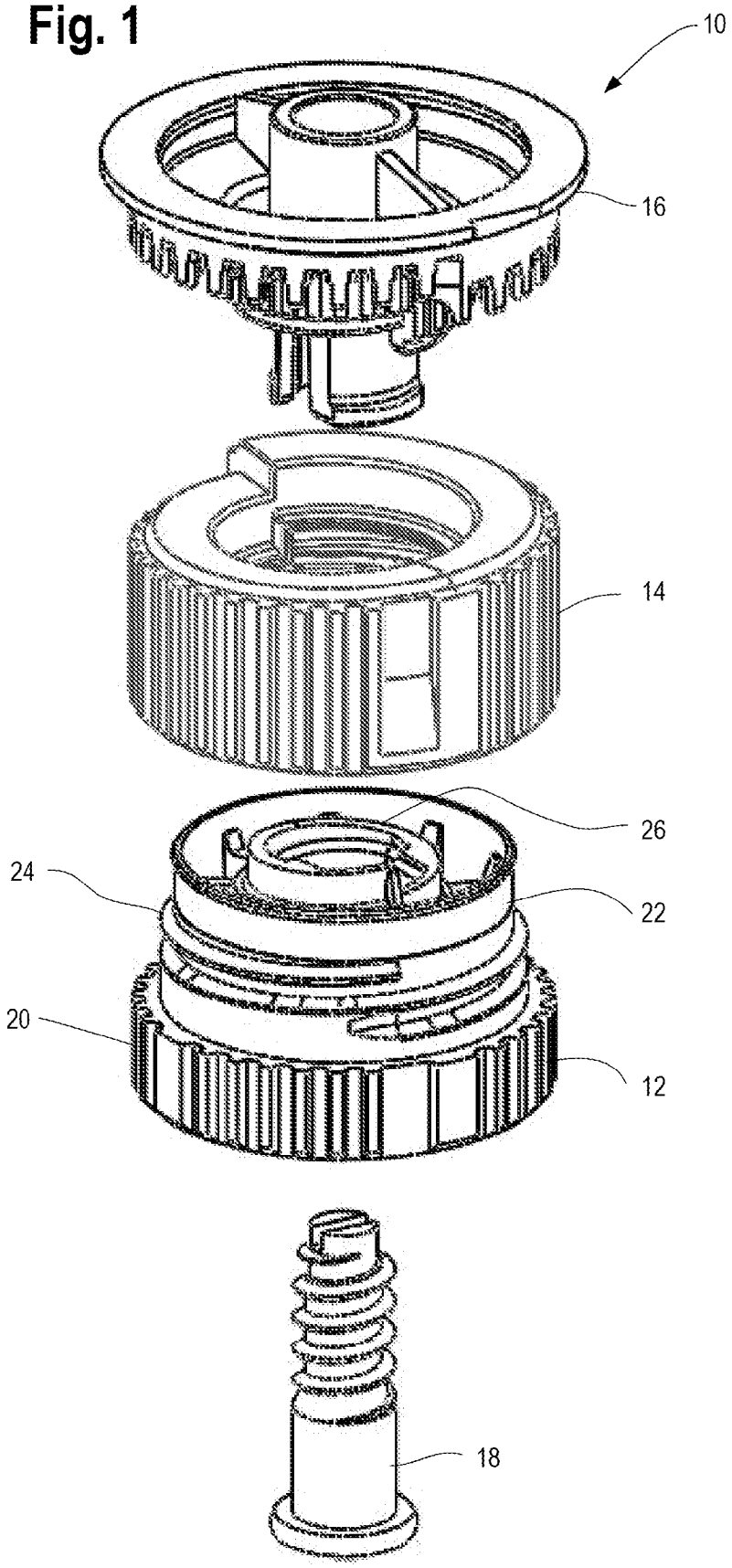
FIG. 1 is an exploded perspective view of an exemplary embodiment of a variable arc irrigation nozzle, depicting a deflector, a collar, a base and an adjustment screw, where the deflector includes a plurality of radially-extending ribs forming channels for water flow therebetween, the ribs having micro-ramps configured for providing different aspects of the spray pattern.
Figure 2:
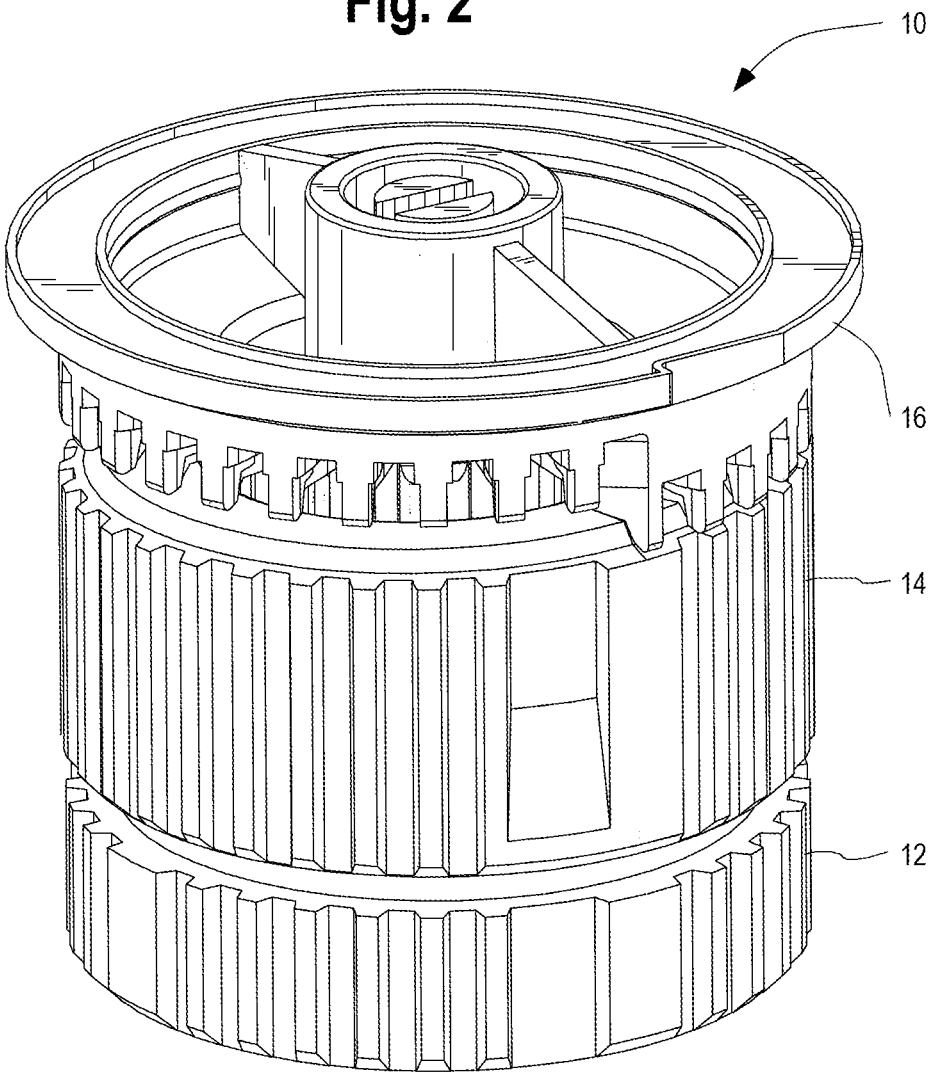
FIG. 2 is a perspective view of the variable arc irrigation nozzle of FIG. 1 in an assembled configuration.
Figure 3:
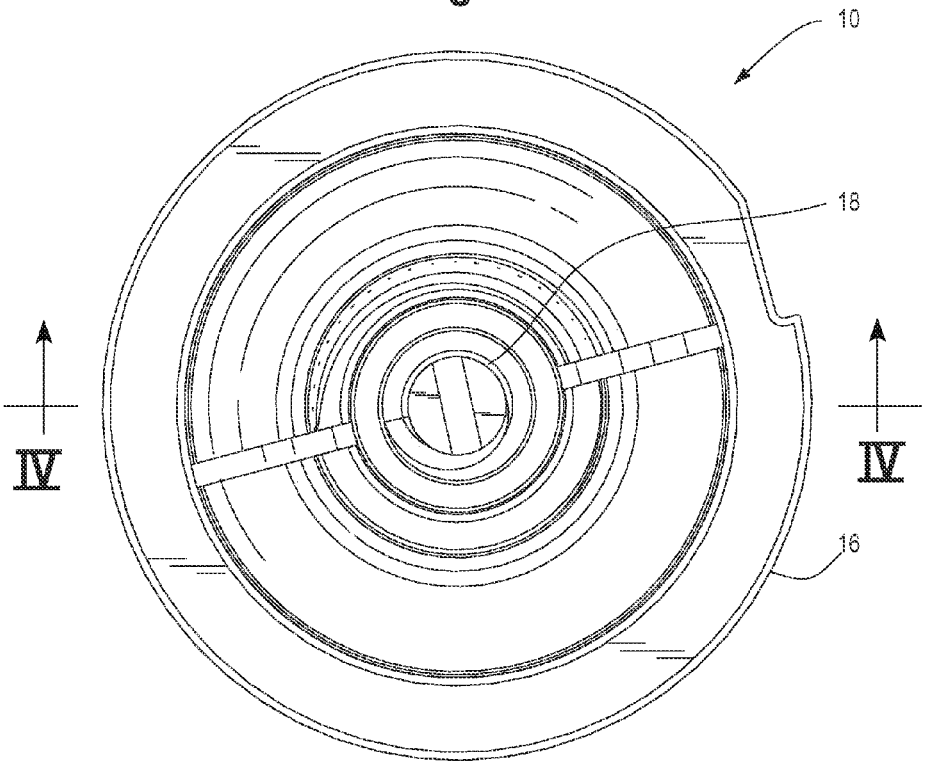
FIG. 3 is a top plan view of the assembled variable arc irrigation nozzle of FIG. 1.
Figure 4:
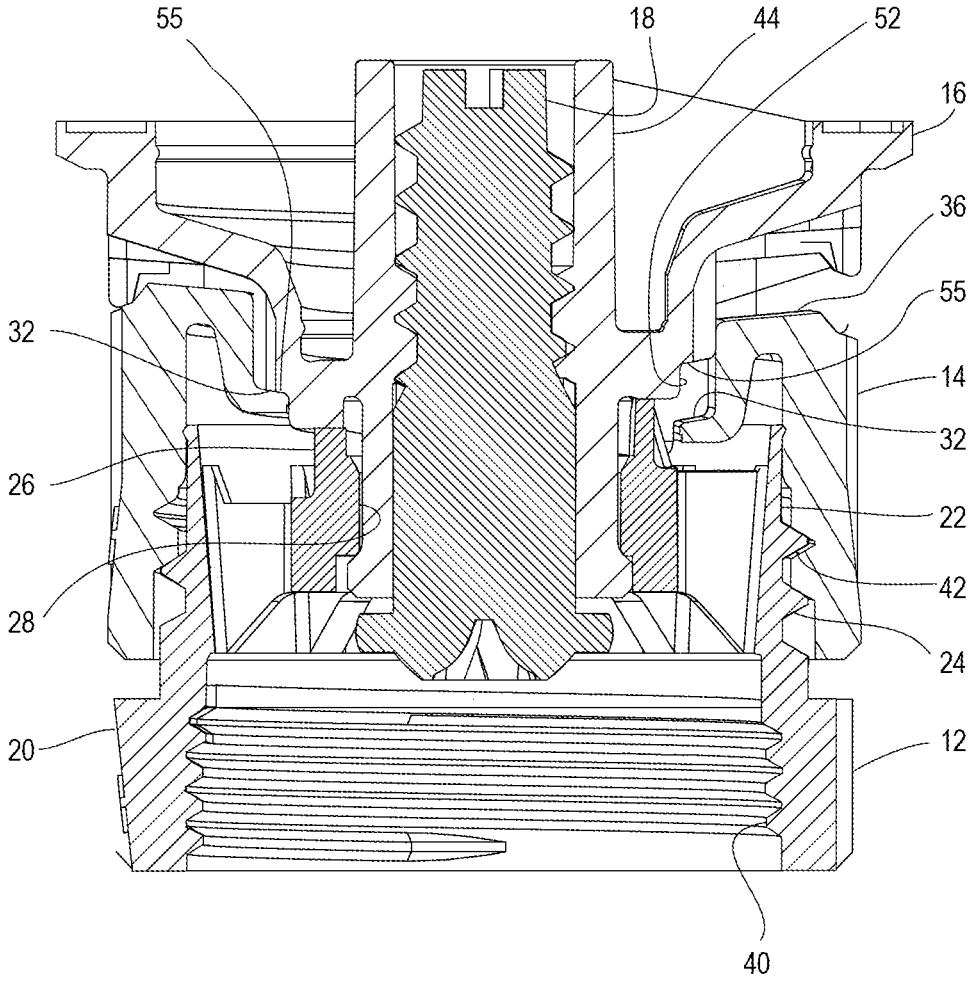
FIG. 4 is a cross-section view of the assembled variable arc irrigation nozzle taken along line IV-IV of FIG. 3.
Figure 12:
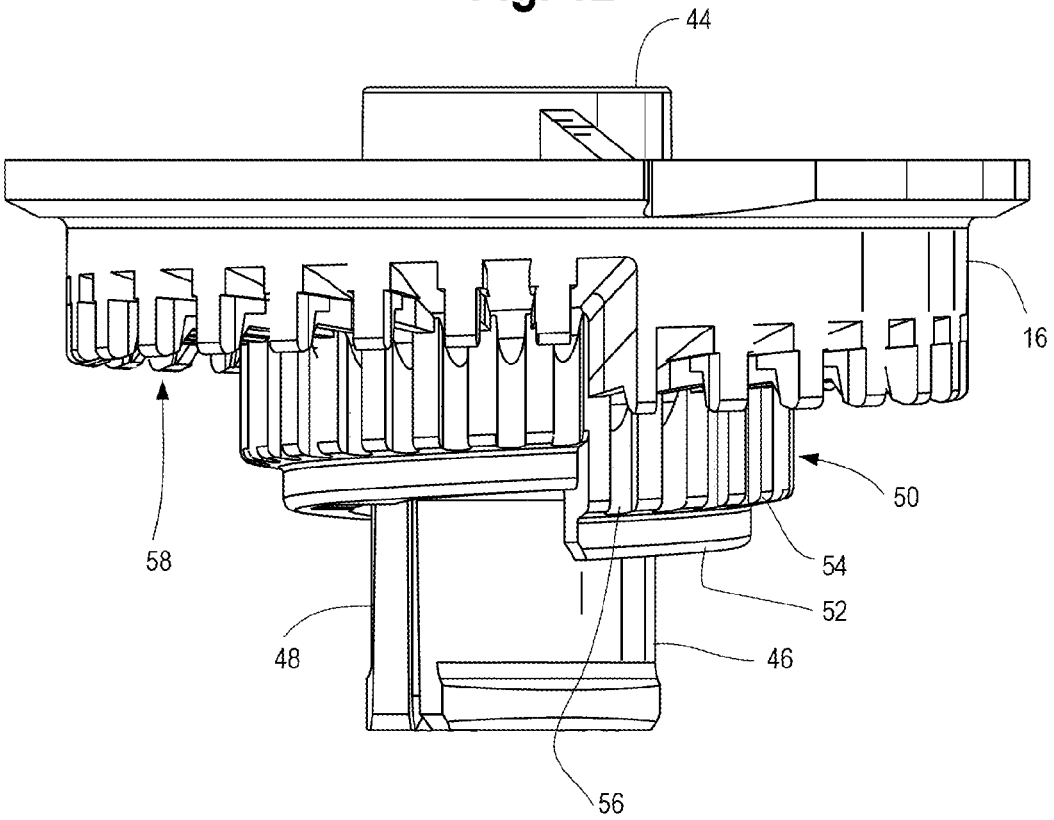
FIG. 12 is a side elevation view of the deflector of the variable arc irrigation nozzle of FIG. 1.

In an exemplary embodiment, a spray nozzle 10 for an irrigation device includes a base 12, a collar 14, a deflector 16 and a screw 18, as illustrated in FIG. 1. The base 12 includes a lower skirt 20 and an upper skirt 22, both surrounding a central opening. The lower skirt 20 includes internal threads 40 (illustrated in FIG. 4) to allow the base 12 (and hence the assembled nozzle 10) to be threadingly connected to a riser, stand or the like of a sprinkler for receiving pressurized water. The upper skirt includes external threading 24 configured to mate with internal threading 42 of the collar 14, as shown in FIG. 4. The collar 14 can be rotated relative to the base 12 along the mating threads 24 and 42 such that the collar 14 can rotate about the base 12. The deflector 16 includes an upper deflector surface 58 with a depending neck 50, as illustrated in FIG. 12. The deflector surface 58 is disposed on an opposite side of the collar 14 from the base 12, and the neck 50 of the deflector 16 extends through the collar 14 and partially into the central opening of the base 12, as depicted in FIG. 4. The depending neck 50 of the deflector 16 is adapted to be attached to the base 12, as will be described in greater detail herein, such that the deflector 16 is not rotatable relative to the base 12. The screw 18 may be an adjustable flow rate adjustment screw to regulate water flow through the nozzle 10.

Figure 7:
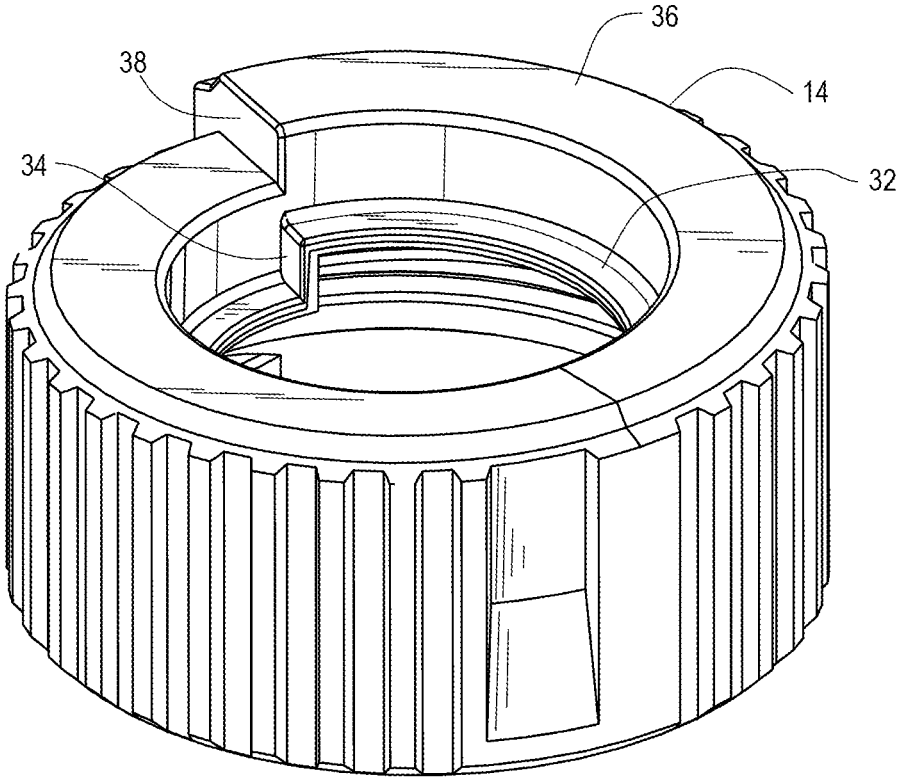
FIG. 7 is a perspective view of the collar of the variable arc irrigation nozzle of FIG. 1.
Figure 8:
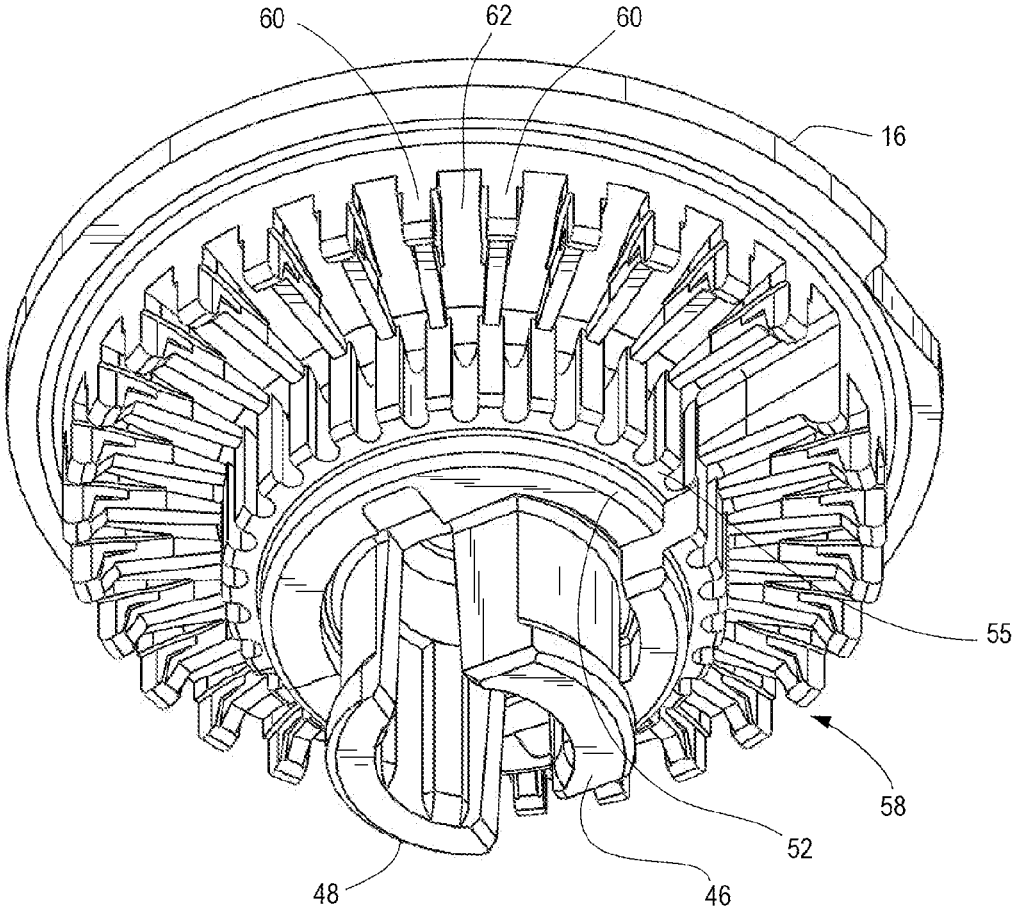
FIG. 8 is a perspective view of the underside of the deflector of the variable arc irrigation nozzle of FIG. 1.

The illustrated embodiment of the nozzle 10 includes variable arc capability such that the arcuate extent of the spray pattern emanating from the nozzle 10 can be adjusted. The collar 14 includes a radially-inward extending helical ledge 32, as illustrated in FIG. 7. Ends of the ledge 32 are axially spaced and are connected by an axially-extending wall 34. The ledge 32 has an upwardly-facing surface and a radially-inward edge surface. An upper face 36 of the collar 14 is also helical, having the same pitch as the ledge 32 and with ends thereof joined by an axially extending face wall 38, also as illustrated in FIG. 7. The neck 50 of the deflector 16 includes a downward-facing helical surface 55 and a depending, radially-outward facing helical wall 52, as illustrated in FIG. 8, both of which have the same pitch as the ledge 32 of the collar 14. The downward-facing helical surface 55 of the deflector 16 lies over the ledge 32 of the collar 14.

As the collar 14 is rotated relative to the deflector 16, however, the radially-inward edge surface of ledge 32 of the collar 14 is brought into or out of sliding and sealing engagement with the helical wall 52 of the deflector 16 in order to increase or decrease the arcuate extent of a water discharge opening. In a fully closed position, the radially-inward edge surface of the ledge 32 of the collar and the helical wall 52 of the deflector 16 are sealingly engaged to block water flow through the spray nozzle. Rotation of the collar 14 then increase the axially spacing between the edge surface of the ledge 32 of the collar and the helical wall 52 of the deflector 16 such that they have overlying segments that are not sealingly engaged through which the water discharge opening is defined. In this manner, the arcuate extent of the water discharge opening, and thereby the arcuate extent of the spray, can be readily adjusted. By way of example, the collar 14 in FIG. 4 has been rotated to a position whereby the water discharge opening is about 180-degrees. As can be seen on the left side of FIG. 4, the edge surface of the ledge 32 of the collar 14 is sealingly engaged with the helical wall 52 of the deflector 16 but on the right side they are axially spaced.

Turning now to details of the upper deflector surface 58 of the deflector 16, a plurality of radially-extending ribs 60 depend from the underside, as illustrated in FIGS. 8-11. Discharge channels for water are formed between adjacent ribs and have bottoms 62 coinciding with the underside of the upper deflector surface 58. The ribs 60 are each configured to divide the water flow through the channels into different sprays directed to different areas and thereby having different characteristics. The different sprays with the different characteristics are combined to provide for an improved spray pattern having improved $DU_{lq}$ and SC values as compared to conventional spray nozzles, including conventional spray nozzles configured for variable arc adjustment, as will be discussed in greater detail herein.

Figure 10:
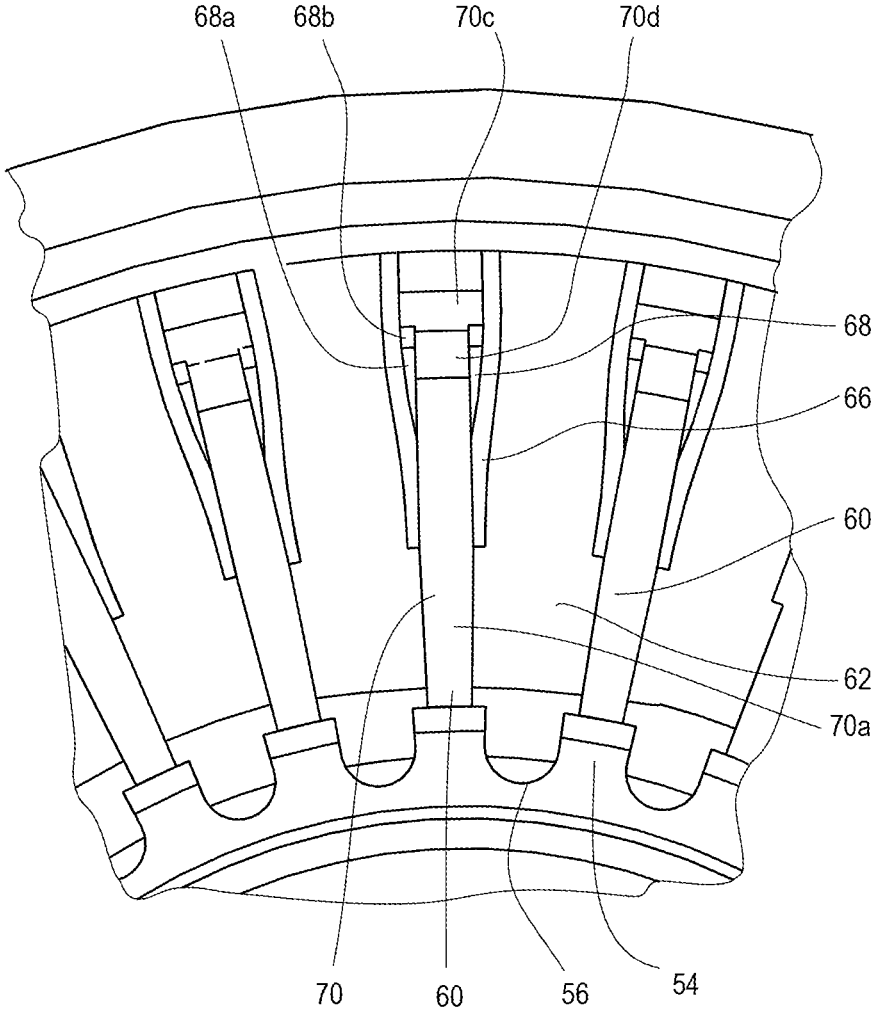
FIG. 10 is a detailed bottom plan view of a portion of the underside of the deflector of the variable arc irrigation nozzle of FIG. 1.
Figure 11:
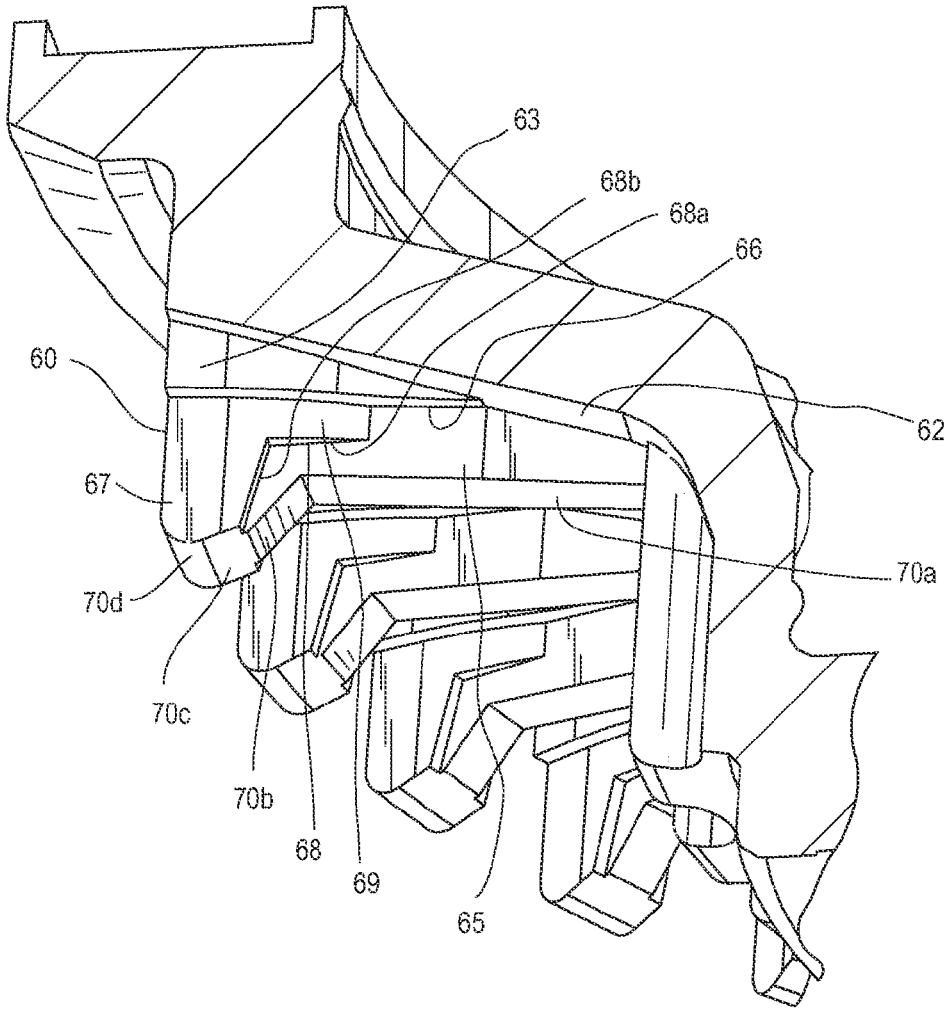
FIG. 11 is a perspective view of a section of the deflector of the variable arc irrigation nozzle of FIG. 1 showing details of the ribs.

Each of the ribs 60 has an inner end adjacent the neck 50, and outer end radially outward from the neck 50, a pair of sidewalls and a bottom wall 70. As the ribs 60 are each generally symmetric about a radially-extending line, only one of the sides of a representative rib 60 will be described with it being understood that the opposite side of that same rib 60 has the same structure. With reference to FIGS. 10 and 11, the rib 60 has a first step 66 forming in part a first micro-ramp and a second step 68 defining in part a second micro-ramp. The first step 66 is generally linear and positioned at an angle closer to perpendicular relative to a central axis of the deflector as compared to the bottom 62 of the upper deflector surface 58, as shown in FIG. 11. The second step 68 is segmented, having an inner portion 68*a* that extends closer to perpendicular relative to the central axis as compared to an outer portion 68*b*, which has a sharp downward angle.

The first and second steps 66 and 68 divide the sidewall into three portions having different thicknesses: a first sidewall portion 63 disposed adjacent an outward region of the bottom 62 of the upper deflector surface 58; a second, narrower sidewall portion 67 disposed partially on an opposite side of the first step 66 from the first sidewall portion 63; and a third, yet narrower sidewall portion 65 having an outer region disposed on an opposite side of the second step 68 from the first step 66, a middle region disposed on an opposite side of the first step 66 from the bottom 62 of the upper deflector surface 58, and an inner region disposed adjacent the bottom 62, as depicted in FIG. 11. The outer portion 68*b* of the second step 68 is spaced inwardly from the outer end of the rib 60 by a second sidewall portion 67. An inclined sidewall segment 69 is disposed radially inward from the second sidewall portion 67.

The underside or bottom wall 70 of the rib 60 has a first, generally linear segment 70*a* positioned at an angle closer to perpendicular relative to a central axis of the deflector 16 as compared to an inner, inclined intermediate segment 70*b* and the bottom 62 of the upper deflector surface 58, as shown in FIG. 11. An outer, inclined intermediate segment 70*c* is closer to perpendicular than the inner intermediate segment 70*b* but not as close to perpendicular as the first segment 70*a*. An upwardly curved segment 70*d* is disposed at the end of the rib 60.

Figure 5:
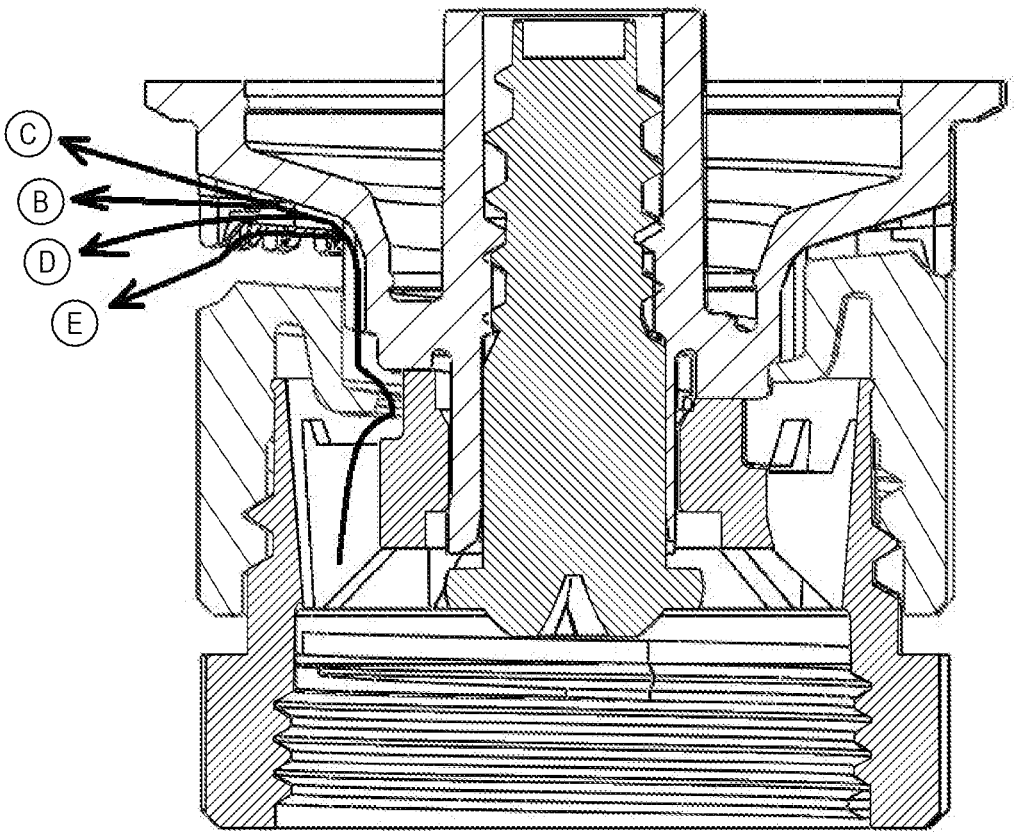
FIG. 5 is a cross-section view of the assembled variable arc irrigation nozzle similar to FIG. 4, but showing diagrammatic flow paths discharging from the nozzle.
Figure 14:
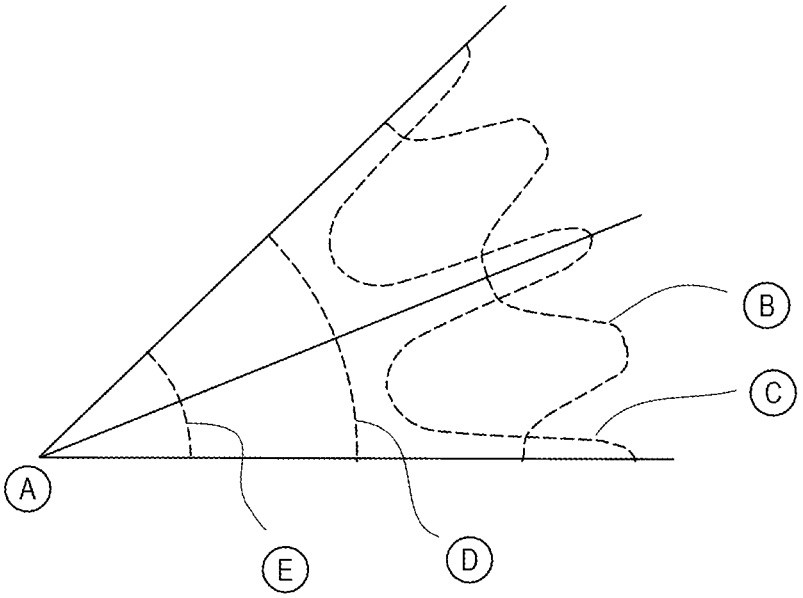
FIG. 14 is a schematic diagram depicting an idealized flow discharging from the variable arc irrigation nozzle of FIG. 1.

The geometries of the ribs 60 and the bottom 62 of the of the upper deflector surface 58 cooperate to define a plurality of micro-ramps which divide the discharging water into sprays having differing characteristics. More specifically, and with reference to FIGS. 5 and 14, there is a first spray B, a second spray C, a mid-range spray D and a close-in spray E as measured from the location A of the spray nozzle 10. The first and second sprays B and C may combine or may be coextensive to form a primary spray. The first and second sprays B and C can have the furthest throw, but may be angularly offset from each other to minimize gaps between the sprays. The mid-range spray D and the close-in spray E are progressively closer to the location A of the spray nozzle 10, as depicted in FIG. 14. When the different sprays are combined, the result is a spray pattern which provides for improved $DU_{lq}$ and SC values as compared to conventional arcuately adjustable, fixed spray nozzles.

Figure 13:
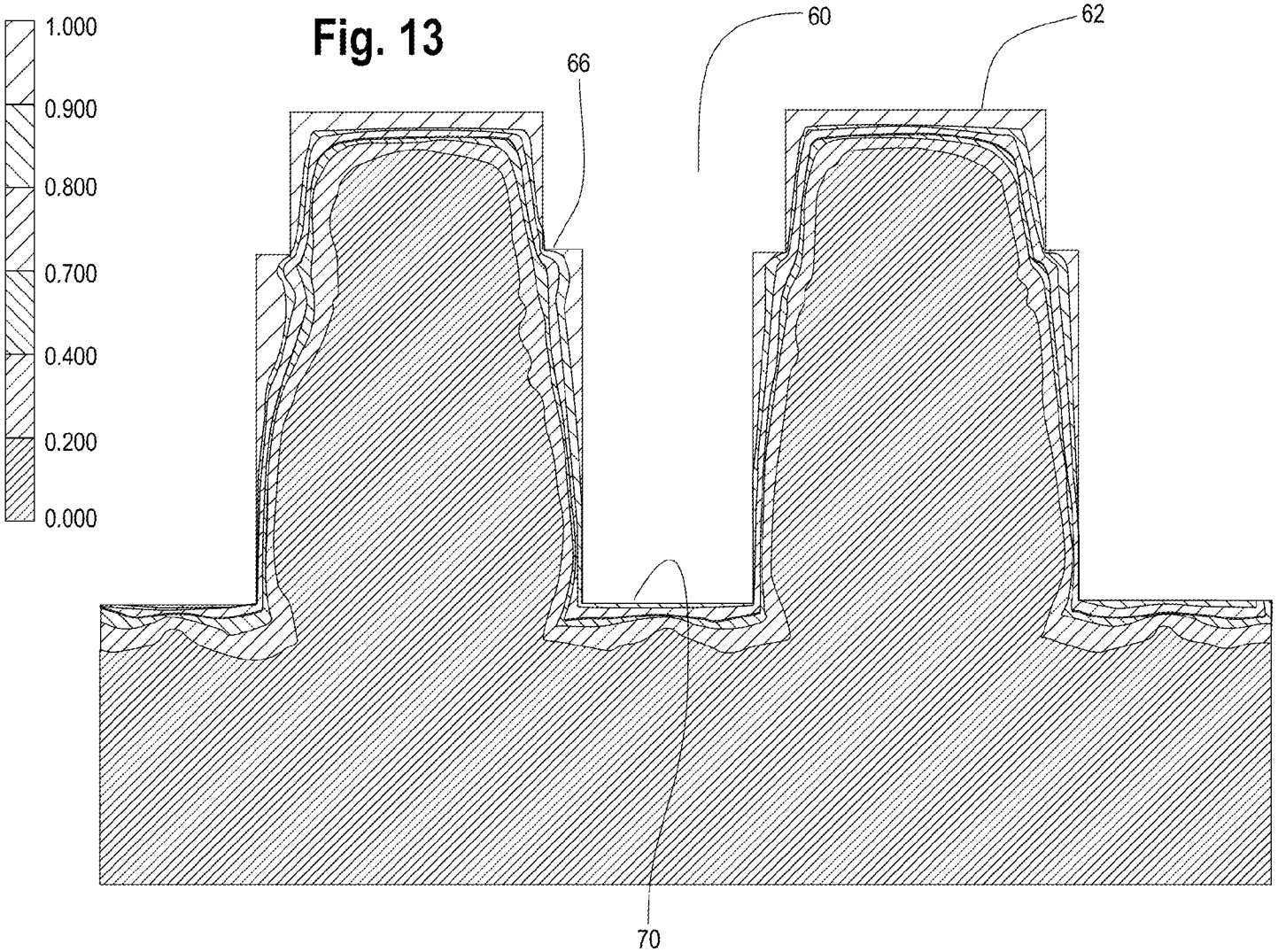
FIG. 13 is an image based upon Computational Fluid Dynamics ("CFD") analysis of water flow along the ribs of the variable arc irrigation nozzle of FIG. 1.

The micro-ramp associated with the first spray B is defined by the first step 66 and the adjacent portions of the sidewall of the rib 60, such as portion of sidewall segment 65, 69 and 67, with reference to FIG. 11. The micro-ramp associated with the second spray C is defined by the bottom 62 of the upper deflector surface 58 and the adjacent portions of the sidewall of the rib 60, such as segment 63, also with reference to FIG. 11. As can be seen from the image of FIG. 13 from the CFD analysis of the water flow, the vast majority of the water tends to flow immediately adjacent the ribs 60 and the bottom 62 of the channels and opposed to evenly filling the space between the ribs 60. Accordingly, the position of the first step 66 relative to the bottom 62 can be selected to vary the amount or fraction of the water flowing along the first micro-ramp as opposed to the second micro-ramp. For example, moving the first step 66 closer to the bottom 62 will increase the depth of the first micro-ramp and thereby increase its fraction of water as compared to the second micro-ramp. As shown in this example, there is a greater fraction of the water flow in the first micro-ramp as compared to the second micro-ramp.

In order to provide for the phase shifting of the spray from the first micro-ramp relative to the spray from the second micro-ramp, the outward ends 67 of the sidewalls of the ribs 60 narrow or taper toward each other, such that a pair of sub-sprays each flowing along the primary micro-ramp on opposite sides of the same rib 60 combine to form a common primary spray. This angularly shifts the first spray from being directly radially outward in the direction of the bottom 62 of the channels.

The micro-ramp associated with the mid-range spray D is defined by second step 68 and those portions of the sidewall of the rib 60 on an opposite thereof from the first step 66, such as a portion of sidewall segments 65. The sharply inclined end segment 68*b* is configured to direct the water spray more downwardly as compared to the spray from the first micro-ramp. Finally, the micro-ramp associated with the close-in spray E is defined by the underside 70 of the rib 60, including the downturned end segments 70*b* and 70*c*, for directing the water flow a shorter throw as compared to the mid-range spray D, the second spray C and the first spray B. It will be understood that the geometries, angles and extend of the micro-ramps can be altered to tailor the resultant combined spray pattern. Further, while it is presently believed to be preferable to have all or nearly all (at least about 80%, 85%, 90%, or 95%) of the ribs 60 with the micro-ramps, it is foreseeable that in some circumstances it may be preferable to have less than all of the ribs include micro-ramps. For instance, the micro-ramps may be on only one side of each of the ribs, may be in alternating patterns, or the like.

Figure 9:
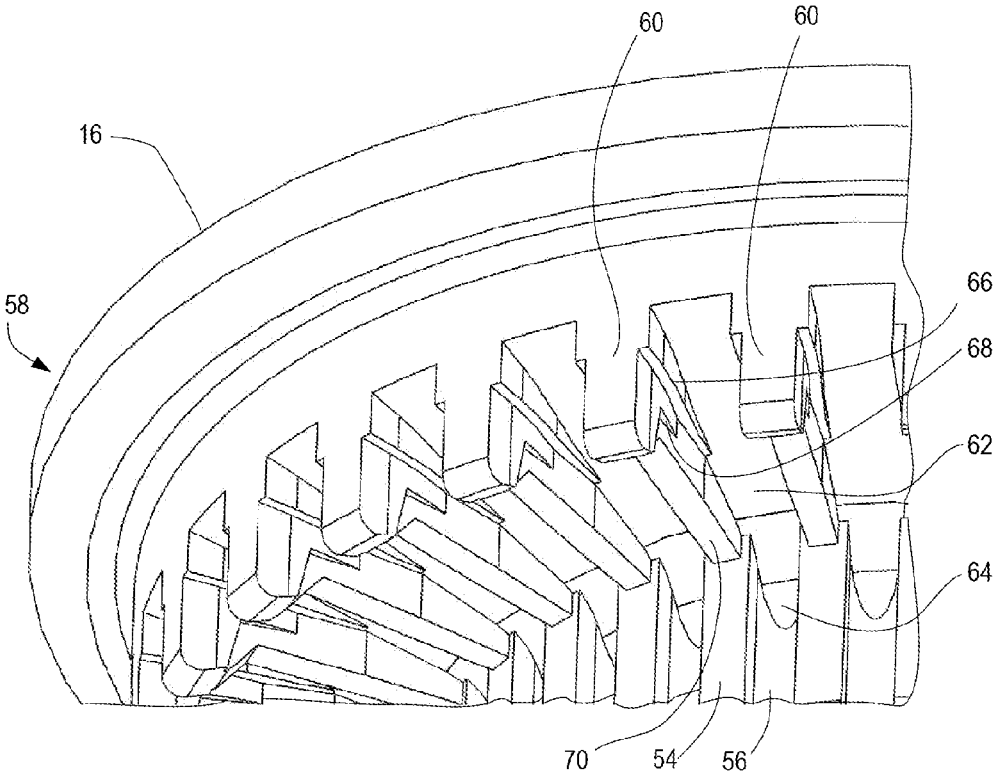
FIG. 9 is a detailed perspective view of some of the ribs on the underside of the deflector of the variable arc irrigation nozzle of FIG. 1.

Extending about the outer circumference of a portion of the neck 50 of the deflector 16 are a plurality of radially-projecting and axially-extending ribs 54 which are spaced by axially-extending flow notches 56. The flow notches 56 have an upstream entrance disposed radially outward from the downwardly-facing helical wall 55, as illustrated in FIG. 8. A downstream exit of the flow notches 56 is aligned with the channels between adjacent ribs 60, as illustrated in FIG. 9. An inclined ramp 64 at the intersection of each of the channels and the flow notches 56 can assist in gradually turning the flow from being generally axially to projecting generally radially outwardly. The flow notches 56 can improve the ability of the spray nozzle 10 to provide for a matched precipitation rate, particularly desirable given the adjustable nature of the arcuate extent of the spray pattern from the spray nozzle 10. In other words, the flow notches 56 contribute to having proportional volumes of water discharged for given arcuate spray pattern settings.

In the exemplary embodiment of a variable arc spray nozzle 10 depicted in the accompanying figures, the nozzle 10 may be configured to have a 12 foot throw. There may be thirty flow notches 56 feeding thirty channels separated by ribs 60, with thirty ribs 60 total and one rib extending from the ends of the helically-inclined array of ribs 60, which one rib lacks micro-ramps in the illustrated embodiment. Each of the axially-extending ribs projects outwardly about 0.0255 inches, has a width at its outward end of about 0.024 inches and adjacent ones form a flow notch 56 with an inward taper of about 6.2 degrees with a bottom radius of about 0.0125 inches. The length may be about 0.92 inches. The inclined ramp 64 may be outwardly-inclined at about 20 degrees relative to a central axis. The ribs 60 are spaced at about 10 degrees to about 12 degrees apart. The first step 66 is between about 0.004 and 0.008 inches in width from the sidewall of the adjacent portion of the rib 60, such as about 0.006 inches. A distal end of each of the ribs 60, including the first step 66, may be about 0.040 inches with about a 3 degree taper, with the portion on the opposite side of the step 66 from the bottom wall 62 being about 0.028 inches in width, with a proximate end of each of the ribs 60 being about 0.018 inches. The second step 68 may be between about 0.002 and 0.006 inches in width, such as about 0.004 inches in width. The angle of the linear portion 70*a* of the bottom wall 62 may be about 9 degrees toward a horizontal plane coinciding with the top of the deflector 16, with the inward segment 70*b* being inclined about 50 degrees away from the plane and the intermediate segment 70*c* being inclined about 20 degrees away from the plane. While these dimensions are representative of the exemplary embodiment, they are not to be limiting, as different objectives can require variations in these dimensions, the addition or subtraction of the steps and/or micro-ramps, and other changes to the geometry to tailor the resultant spray pattern to a given objective.

Figure 6:
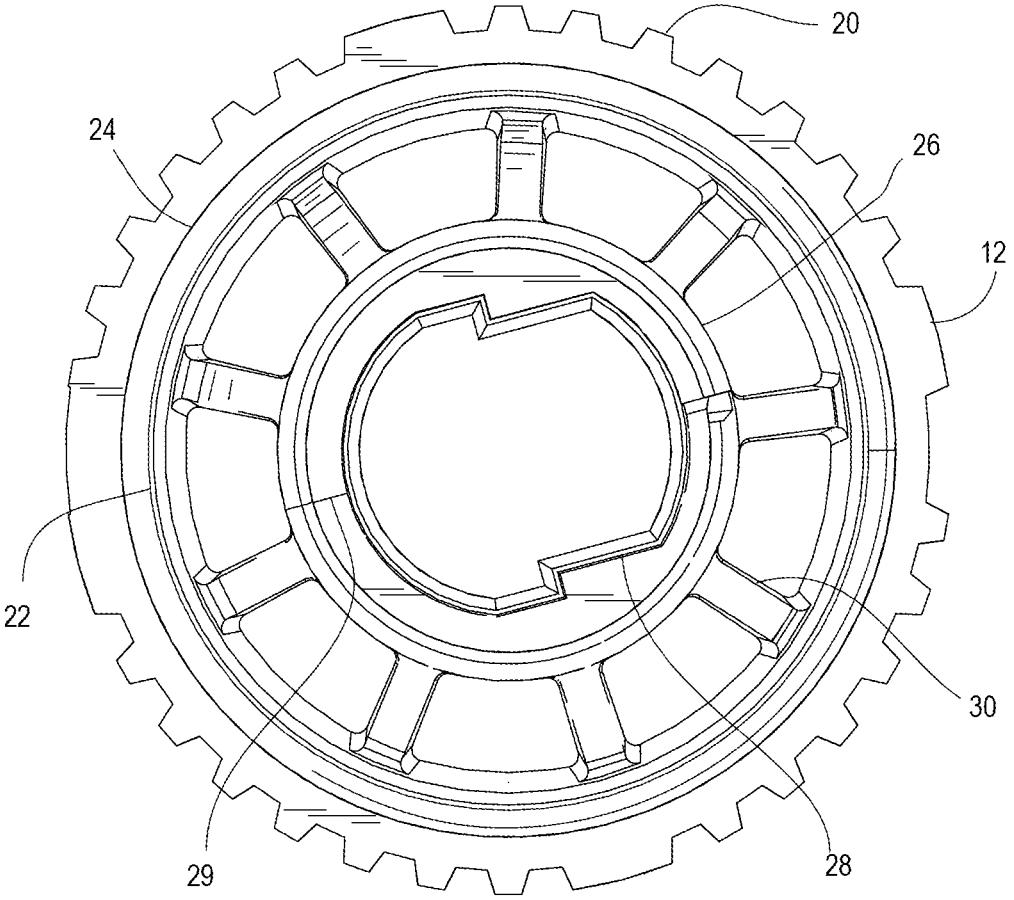
FIG. 6 is a top plan view of the base of the variable arc irrigation nozzle of FIG. 1.

The deflector 16 is attached to the base 12 via engagement between a pair of depending prongs 46 and 48 of the neck 50 and structure surrounding the central opening of the base 12. More specifically, the base 12 includes an interior center disc 26 supported in spaced relation from the upper skirt 22 via a plurality of connecting webs 30, as depicted in FIG. 6. The central opening 28 extends through the disc 26. Barbed ends of the prongs 46 and 48 are configured to extend through the central opening 28 to form a cantilever snap fit to secure the deflector 16 relative to the base 12 with the collar 14 therebetween. Further, the central opening 28 is optionally key-shaped or otherwise asymmetric in at least one direction. When one of the prongs 48 is larger than the other of the prongs 46 in its arcuate extent, as depicted in FIG. 8, the key-shaped central opening 28 and the differently-sized prongs 46 and 48 can cooperate to ensure that the deflector 16 can only be attached to the base 12 in a single preferred orientation.

It will be understood that various changes in the details, materials, and arrangements of parts and components, which have been herein described and illustrated in order to explain the nature of the invention may be made by those skilled in the art within the principle and scope of the invention as expressed in the appended claims.

The invention claimed is:

1. An irrigation spray nozzle comprising:

a nozzle body defining at least in part one or more fluid discharge flow passages for the passage of water; and a deflector to deflect water received from the one or more fluid discharge flow passages, the deflector having radially extending ribs depending from an underside of the deflector, adjacent ones of the ribs forming channels for water flow therebetween, a plurality of the ribs from the radially extending ribs, each rib of the plurality of the ribs having a pair of opposing sides, and each side comprises at least a first step extending into an adjacent one of the channels and at least partially in a radially extending direction such that a micro-ramp extends into the adjacent one of the channels for directing a portion of the water flow, the micro-ramp being spaced from a bottom of the channel defined by the underside of the deflector, the micro-ramps on the pair of opposing sides of each of the plurality of the ribs being spaced from each other.

2. The irrigation spray nozzle of claim 1, wherein the plurality of ribs are each wider on a side of the first step adjacent the bottom of the channels than on an opposite side of the first step from the bottom of the channels.

3. The irrigation spray nozzle of claim 1, wherein at least some of the plurality of the ribs each have at least the first step and a second step on a common side and extending into an adjacent one of the channels and at least partially in a radially extending direction such that more than one micro-ramp extends into the adjacent one of the channels for directing a portion of the water flow, each of the more than one micro-ramps being spaced from the bottom of the channel.

4. The irrigation spray nozzle of claim 3, wherein the plurality of ribs are each wider on a side of any one of the more than one step adjacent the bottom of the channels than on an opposite side of the one of the steps from the bottom of the channels.

5. The irrigation spray nozzle of claim 4, wherein the first step is closer to the bottom of the channel than the second step, and each of the plurality of the ribs having an underside, the bottom of the channels, the first steps, second steps and underside of the ribs each configured to provide for more than one discrete spray.

6. The irrigation spray nozzle of claim 5, wherein the first step directs a first segment of the spray, the second step directs a mid-range spray segment extending closer from the spray nozzle as compared to the first segment of the spray, the underside of the rib directs a close-in spray segment extending closer from the spray nozzle as compared to the mid-range spray segment, and the bottom of the channel directs a second spray segment extending further than the mid-range and close-in spray segments and orientated out of phase with the first segment of the spray.

7. The irrigation spray nozzle of claim 1, wherein the deflector has an upper portion with an underside with the radially extending ribs thereon and a lower portion with a neck depending from the underside with flow notches disposed about its outer periphery, the flow notches of the neck being aligned with and intersecting channels formed between the radially extending ribs such that water flow paths extend through the flow notches of the neck and into the channels.

8. The irrigation spray nozzle of claim 1, further comprising:

a base having a first end portion adapted for attachment to an irrigation device and a second end portion;

a first helical surface fixed relative to the base;

a second helical surface rotatable relative to the base, the first and second helical surfaces cooperating to define an arcuate flow passage adjustable in size to determine an arc of spray distribution upon relative rotation between the first and second helical surfaces.

9. The irrigation spray nozzle of claim 8, wherein the nozzle body is a collar mounted for rotation about the second end portion of the base and includes the second helical surface and a neck of the deflector includes the first helical surface.

10. The irrigation spray nozzle of claim 9, wherein the deflector has an upper portion with the radially extending ribs and wherein the neck of the deflector depends from the underside of the deflector and has flow notches disposed about its outer periphery, the flow notches being aligned with and intersecting the channels formed between the ribs such that water flow paths extend through the flow notches and into the channels.

11. The irrigation spray nozzle of claim 1, wherein each of the plurality of the ribs have a bottom wall having a first segment and a second segment, the second segment being radially outward relative to the first segment and inclined relative to the first segment.

12. An irrigation spray nozzle comprising:

a base having a longitudinal axis and at least one water passage extending through the base; and a deflector body having a deflector portion and a neck, the deflector portion being positioned to receive a discharge of water from the at least one water passage and redirecting the discharge of water generally radially outward, the deflector portion having a plurality of radially-outward extending, depending ribs with adjacent ones of the depending ribs forming channels for water flow therebetween, the plurality of radially-outward extending, depending ribs each having a pair of sidewalls and a bottom wall, the sidewalls each at least partially defining a plurality of distinct micro-ramps projecting laterally into the channels and spaced from a bottom of the channels defined by an underside of the deflector portion, for dividing the discharge of water into different sprays for irrigating different areas adjacent the irrigation spray nozzle.

13. The irrigation spray nozzle of claim 12, wherein a plurality of flow notches are disposed about an outer periphery of the neck, the plurality of flow notches being aligned with and intersecting the channels formed between the ribs such that water flow paths extend through the flow notches into the channels.

14. The irrigation spray nozzle of claim 12, wherein each rib has a plurality of steps on the same side each projecting toward an adjacent rib a different distance.

15. The irrigation spray nozzle of claim 12, wherein the plurality of micro-ramps includes a first micro-ramp and a second micro-ramp on a common side of one of the ribs, the first micro-ramp has a radially-outward portion that is inclined to a greater degree than the second micro-ramp.

16. The irrigation spray nozzle of claim 15, wherein the bottom wall of each of the ribs has a radially outward portion that is inclined to a greater degree than the radially-outward portion of the first micro-ramp.

17. The irrigation spray nozzle of claim 16, wherein the sidewalls of each of the ribs at a radially outward end taper toward each other.

18. The irrigation spray nozzle of claim 12, wherein:

the lower neck of the deflector body has a deflector helical surface that is fixed relative to the base; and a collar is mounted for rotation relative to a portion of the base, the collar having a collar helical surface configured to cooperate with the deflector helical surface to define an arcuate flow opening upstream of the upper deflector portion and adjustable in size to determine an arc of water distribution upon rotation of the collar relative to the deflector body.

19. The irrigation spray nozzle of claim 12, wherein the plurality of micro-ramps includes a first micro-ramp, spaced from the underside of the deflector portion, comprising a first step that is generally linear and positioned at an angle closer to perpendicular relative to a central axis of the deflector as compared to the underside of the deflector portion.

20. The irrigation spray nozzle of claim 19, wherein the plurality of micro-ramps includes a second micro-ramp, on a common sidewall as the first micro-ramp, comprising a second step that is segmented, having a radially inward portion that extends closer to perpendicular relative to the central axis as compared to a radially outward portion.

21. A method for forming a spray of water from an irrigation spray nozzle, the nozzle having a deflector with a plurality of radially-outward extending, depending ribs forming channels for water flow therebetween, the ribs each having a pair of sidewalls and a bottom wall, the sidewalls each having at least one step projecting laterally a first distance from the sidewall and spaced from a bottom of the channel, the method comprising:

discharging water against the deflector; and deflecting at least some of the water generally radially outward along a plurality of flow paths disposed between adjacent pairs of the ribs and the bottom of the channels, a first of the flow paths on a side of the step closer to the bottom wall having a first fraction of the total discharged water volume and a second of the flow paths on a side of the step opposite the bottom wall having a second fraction of the total discharged water volume, the second fraction being different than the first fraction.

22. The method of claim 21, wherein the step of deflecting the water radially outward further includes redirecting a secondary portion of the water from the second of the flow paths to thereby having a primary and secondary portion of the water, the secondary portion of the water having a throw different than that of the primary portion.

23. The method of claim 22, wherein the step of discharging water and against the deflector further includes the step of dividing the water into discrete flows upstream of the deflector and directing each of the discrete flows into an associated one of the channels.

24. The method of claim 23, further including the step of deflecting a portion of the water generally radially outward along a plurality of close-in flow paths, each of the close-in flow paths being disposed on an underside of the ribs, the water discharging along the close-in flow path having a throw less than the first of the flow paths.

25. The method of claim 21, further including a step of adjusting an arcuate extent of a discharge opening prior to the step of discharging water against the deflector.

* * * * *